US006691987B1

(12) United States Patent
Bonham

(10) Patent No.: US 6,691,987 B1
(45) Date of Patent: Feb. 17, 2004

(54) PORTABLE JUMP UNIT

(76) Inventor: Michael Bonham, 20482 E. 470th Rd., Claremore, OK (US) 74017

( * ) Notice: Subject to any disclaimer, the term of this patent is extended or adjusted under 35 U.S.C. 154(b) by 26 days.

(21) Appl. No.: 10/025,341

(22) Filed: Dec. 19, 2001

(51) Int. Cl.[7] ..... A01K 15/02
(52) U.S. Cl. ..... 256/1; 256/19
(58) Field of Search ..... 256/1, 19; 312/118, 312/120; 206/736, 278, 278.1, 279, 319

(56) References Cited

U.S. PATENT DOCUMENTS

| | | | | | |
|---|---|---|---|---|---|
| 3,789,801 | A | | 2/1974 | Moreng | |
| 4,203,525 | A | | 5/1980 | Okubo | |
| 4,561,705 | A | * | 12/1985 | Schafer | 312/244 |
| 4,946,139 | A | | 8/1990 | Tomellini | |
| 5,586,520 | A | | 12/1996 | Cleary | |
| 5,913,283 | A | | 6/1999 | Coury | |
| 6,076,472 | A | * | 6/2000 | Lloyd | 108/36 |
| 6,152,430 | A | | 11/2000 | Thoman | |
| D437,145 | S | * | 2/2001 | Leng | D6/429 |
| 6,464,260 | B1 | * | 10/2002 | Barrier | 285/91 |
| 2002/0170470 | A1 | * | 11/2002 | Cheng | 108/69 |

OTHER PUBLICATIONS

Affordable Jumps for the Serious Rider.*
KBF Enterprises Discount Jumps.*

* cited by examiner

*Primary Examiner*—John R. Cottingham
(74) *Attorney, Agent, or Firm*—Molly D. McKay

(57) ABSTRACT

A light weight, folding, portable jump unit for use in horse jumping constructed of durable and weather proof materials. The unit is constructed in two halves that fold together so that their flat backs are touching. Fasteners hold the unit in a folded position and handles are provided on the top of the halves as a way of carrying the unit. In use, the halves are extended so that they are aligned with each other and are placed between the traditional jumping standards. Each half is provided with a broad base so that the unit is free standing and stable. The bases are optionally provided with grommets for admitting bouquets of artificial flowers, provided with a curtain for draping over a pole that extends between the jumping standards, and with one or more flaps onto which pole are placed for further stabilizing the unit.

1 Claim, 2 Drawing Sheets

PORTABLE JUMP UNIT

BACKGROUND OF THE INVENTION

1. Field of the Invention

The present invention relates to a portable jump unit used when engaging in horse jumping competition or practicing horse jumping. More specifically, the present invention is a light weight, folding jump unit that can be folded in half so that it can easily be carried by one person.

2. Description of the Related Art

Currently when competitors prepare the jump area for horse jumping competition or to practice horse jumping, they must carry large, heavy items onto the field in order to construct a jump unit that is esthetically pleasing and is stable enough to withstand high winds, rain, and other environmental conditions often encountered by jump units. These items are often heavy and bulky and require more than one person to carry onto and off of the jump field or arena.

The present invention addresses this problem by providing a jump unit that is foldable, light weight and can easily be carried by one person so that a single person can quickly build an attractive and functional jump unit. The present invention is water resistant, durable, and stable in high winds.

SUMMARY OF THE INVENTION

The present invention is a light weight, folding, portable jump unit for use in horse jumping competition or when practicing horse jumping. The invention is constructed of durable, water proof light weight material. Although various types of materials can be used to construct the jump unit, preferred materials of construction are sheets of foam material provided with a rigid backing such as a waterproof board and the entire unit covered with a durable, waterproof material such as Herculite® material. The unit is constructed in two pieces that are hinged together in the middle of the jump unit so that the jump unit can be folded with the backs of the two halves folding together in parallel alignment. Each half of the jump unit is provided with Velcro closure to secure the jump unit in its folded position and provided with handles so that the jump unit can be carried by grasping the handles with one hand.

Each half of the jump unit is provided with a wide base that allows the jump unit to stand upright on its lower base portion so that its upper portion extends upward between upright standards provided by the group or individual sponsoring the jumping competition. In addition to the two upright standards, the sponsoring group or individual also provides three poles, i.e. one pole for hanging horizontally between the upright standards above the portable jump unit, and one pole for placement on the ground on the front and the rear sides of the jump unit so that each of these two poles are parallel with the hanging pole and with the longitudinal axis of the portable jump unit. The pole which rests horizontally on the standards is optional.

The jump unit is optionally provided with one or more flaps permanently attached to the base. The loose side of the flap is removably secured with Velcro® to the base when not in use and is detached from the base so that the flap lays on the ground when in use. When in use, a pole is placed on top of the flap as a further means of securing and stabilizing the jump unit against strong winds. Although not illustrated, another flap may also be provided on the back side of the jump unit similar to the flap that is illustrated provided on the front of the jump unit.

Also, the jump unit is optionally provided with grommets in the base. The purpose of these grommets is to serve as openings through which the stems of bouquets of artificial flowers can optionally be inserted so that the stems stick into the underlying foam material as a means of securing the bouquet to the base.

The jump unit may be provided with no curtain, may be provided with a detachable curtain that secures to the upper portion of the jump unit via a strip of Velcro® fastener provided along the upper portion of the jump unit or may be provided with a curtain that permanently attaches along the upper portion of the jump unit and can be rolled into a cylindrical tube for storage employing a strip of Velcro® fastener provided along the upper portion of the jump unit.

The shape of the jump unit can vary. For example the jump unit may be in the form of a vertical wall with a lower base extending outward horizontally from the wall along the lower portion of the wall. Such a wall might be painted or otherwise decorated to look as if it were constructed of natural building materials, such as for example, a wooden fence or a brick wall, and the base might be provided with bouquets of flowers extending upward there from. On the other hand, the jump unit might be in the form of a quarter-round with a smooth curved, contoured surface extending from the upper portion of the jump unit to the lower base portion. Such a jump unit might be painted or otherwise decorated to resemble natural building materials, such as for example a pile of logs or a mound of dirt.

DETAILED DESCRIPTION OF THE PREFERRED EMBODIMENTS INVENTION

Figure 1:
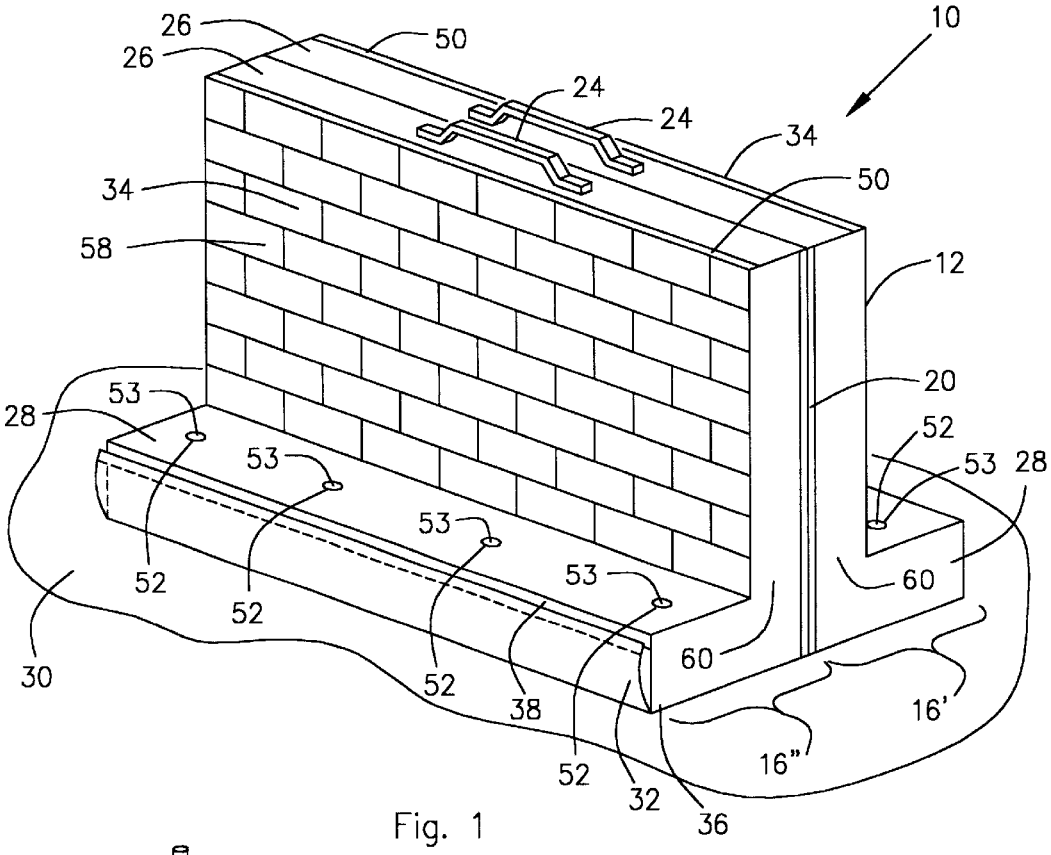
FIG. 1 is a perspective view of a portable jump unit constructed in accordance with a preferred embodiment of the present invention, shown in its folded position.
Figure 2:
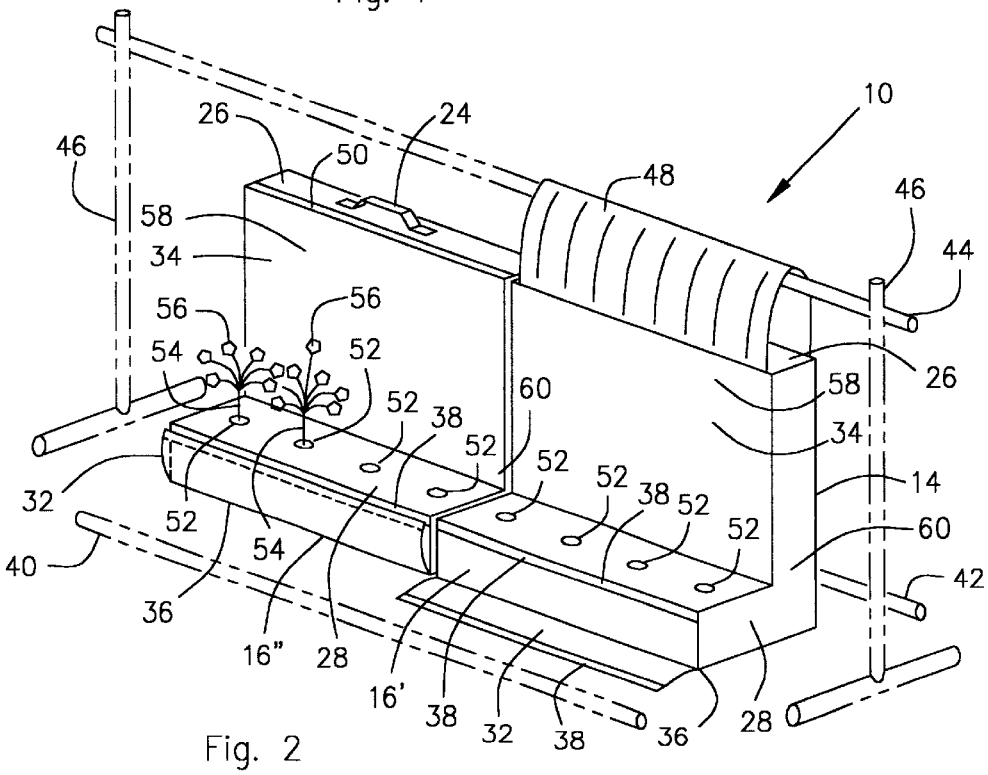
FIG. 2 is a perspective view of a portable jump unit similar to the one pictured in FIG. 1, shown in its unfolded, in-use position.
Figure 3:
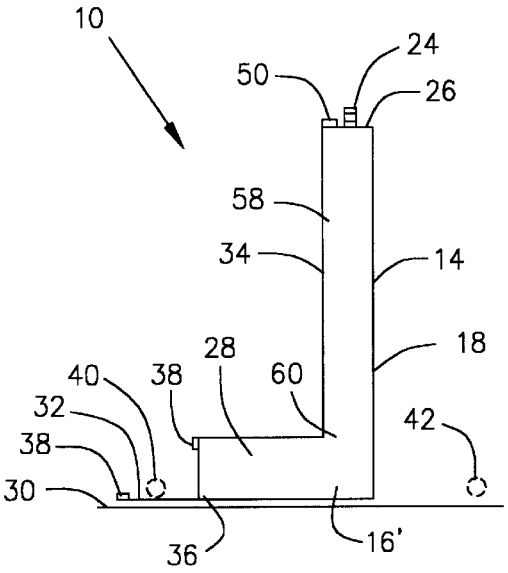
FIG. 3 is a side view of the jump unit of FIG. 2.
Figure 4:
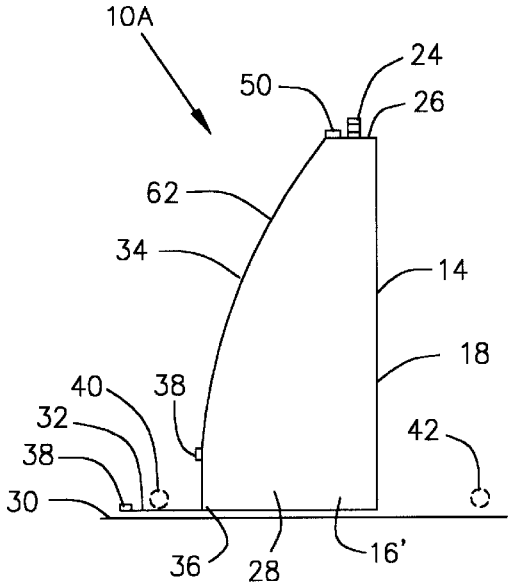
FIG. 4 is a side view of an alternate embodiment of the present invention.
Figure 5:
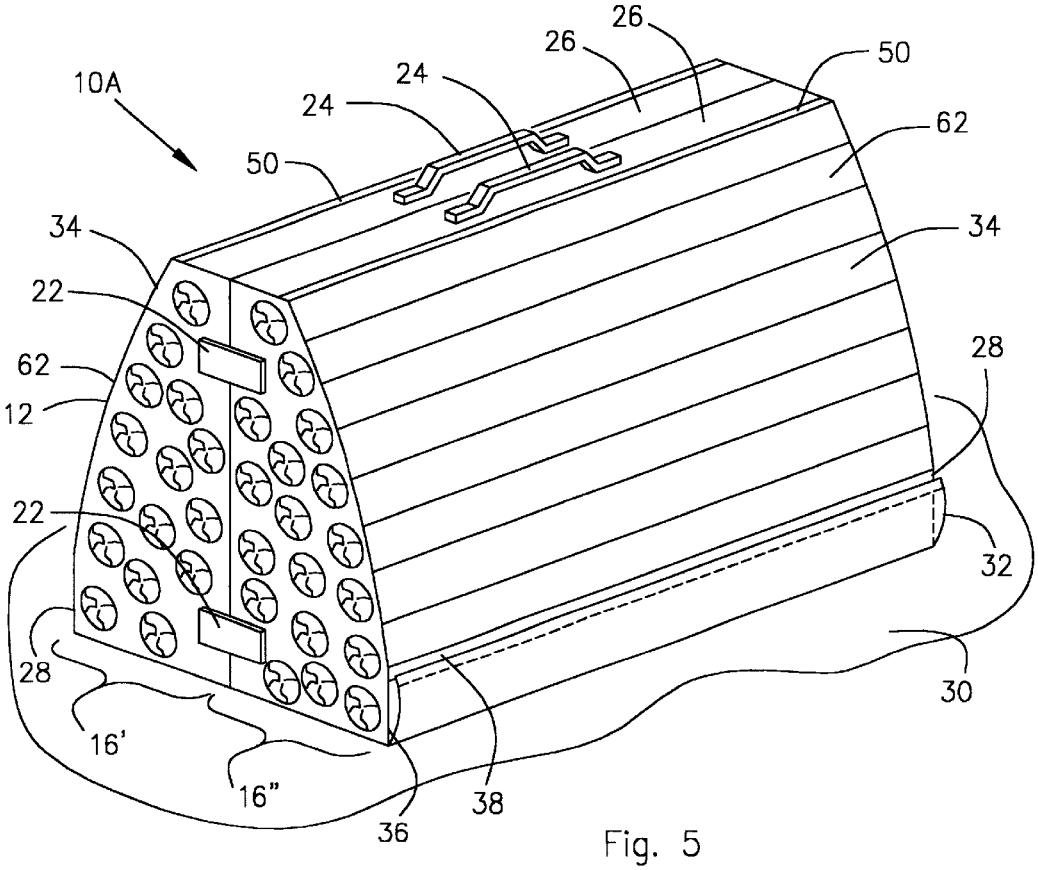
FIG. 5 is a perspective view the alternate embodiment portable jump unit of FIG. 4, shown in its folded position with the two halves held together with fastening strips.

Referring now to the drawings and initially to FIGS. 1–3, there is illustrated a portable jump unit 10 constructed in accordance with a preferred embodiment of the present invention. FIGS. 4 and 5 illustrate an alternate embodiment portable jump unit 10A.

FIG. 1 shows the jump unit 10 in its folded position 12, and FIG. 2 shows the jump unit 10 in its unfolded, in-use position 14. The jump unit 10 is constructed of two halves 16' and 16" that are secured together along one edge of their backs 18' and 18" via a vertical hinge 20 so that the halves 16' and 16" can be folded together in a folded position 12, as shown for jump unit 10 in FIG. 1 and as shown for the alternate embodiment 10A in FIG. 5. In the folded position 12, the backs 18' and 18" of the halves 16' and 16" are adjacent and abutting each other with their backs 18' and 18" parallel to each other. As illustrated in FIG. 5, one or more fastening straps 22 removably attach to the halves 16' and 16" to hold the halves 16' and 16" in the folded position 12 as the unit 10 or 10A is carried. Handles 24 are provided on an upper edge 26 of each of the halves 16' and 16" of the units 10 and 10A as a means of lifting and carrying the units 10 and 10A. The handles 24 are designed so that they can be grasped by a single hand of one person.

The units 10 and 10A are each provided with a broad base 28 on which the unit 10 or 10A rests as it sits upon the ground 30. The broadness of the base 28 provides stability to the units 10 and 10A and prevents them from toppling over in high winds or if the unit 10 or 10A is struck slightly by a horse.

The units 10 and 10A optionally may include flaps 32 on the front 34 of each half 16' and 16" of the unit 10 or 10A that permanently secure to the half 16' or 16" at the lower edge 36 of the base 28, and the loose flaps 32 removably secure to the unit 10 and 10A via fasteners 38, such as for example Velcro® fasteners, that are provided slightly higher up on the base 28. In use, each flap 32 is detached from its mating half of the Velcro® fastener 38 and is extended onto the ground 30 in front of the unit 10 or 10A, as illustrated in the right half of FIG. 2 and in FIGS. 3 and 4. Once the flap 32 is extended onto the ground, one pole 40 of the three poles 40, 42, and 44 that are normally provided to competitors at horse jumping competitions is placed on top of the horizontally extending flap 32 to further secure the unit 10 or 10A to the ground 30 and to serve as a ground marker. Although not illustrated, another flap similar to the flap 32 may be provided on the back side of the units 10 and 10A. A second pole 42 is placed on top of the optional flap provided on the back side of the units 10 or 10A, or alternately, if an optional back flap is not provided, the second pole 42 is placed on the ground 30. The second pole 42 serves as a ground marker. A third pole 44 is optionally placed in a horizontal position suspended above the unit 10 or 10A between two upright standards 46 that are also provided to each competitor along with the three poles 40, 42, and 44. The two upright standards 46 are placed on either end of the jump unit 10 or 10A, as illustrated in FIG. 2 for jump unit 10, and the third pole 44 is approximately parallel with the unit 10 or 10A and suspended above it when the third pole 44 is optionally employed.

Also, as illustrated on the right hand side of FIG. 2, a curtain 48 may be attached to the upper edge 26 of the unit 10 or 10A so that the curtain 48 can be draped over the third pole 44. The curtain 48 may be either permanently attached to the unit 10 or 10A or may be removably attached via a fastener 50, such as for example a Velcro® fastener. If the curtain 48 is permanently attached, the fastener 48 can be employed to hold the curtain 48 in a rolled up, stored position on the upper edge 26 of the unit 10 or 10A when the unit 10 or 10A is in its folded position 12 or at any time when the curtain 48 is not in use.

As illustrated in FIGS. 1 and 2, grommets 52 having central openings 53 there through may optionally be provided in the base 28 to allow stems 54 of bouquets 56 of artificial flowers to be removably attached to the unit 10 or 10A by inserting the stems 54 into the openings 53 in the grommets 52.

Although the units 10 and 10A may be constructed of any of a variety of suitable materials, use of foam covered with a weatherproof material such as Herculite® material have been successfully employed. The foam is light weight, but has sufficient strength and body to hold the desired shape while the Herculite® material provides a durable, weatherproof covering for the units 10 and 10A. It is desirable that the backs 18' and 18" are rigid to facilitate carrying the units 10 and 10A, and this can be achieved by securing a rigid piece a material, such as for example a thin piece of waterproof plywood or similar material, onto the backs 18' and 18" of each half 16' and 16" of the units 10 or 10A before the units 10 or 10A are covered with the Herculite® material.

As illustrated in FIGS. 1 and 3 and FIGS. 4 and 5, the shape of the jump unit 10 or 10A can vary. For example the jump unit 10, illustrated in FIGS. 1–3, is in the form of a vertical wall 58 with the base 28 extending outward horizontally from the wall 58 at the lower end 60 of the wall 58. Such a wall 58 might be undecorated, as illustrated in FIG. 2, or may be painted or otherwise decorated to look as if it were constructed of conventional natural building materials, such as for example a wooden fence or a brick wall, as illustrated in FIG. 1. As illustrated in FIGS. 4 and 5, the alternate jump unit 10A might, on the other hand, be in the form of a quarter-round with a smooth curved, contoured surface 62 extending from the upper edge 26 of the jump unit 10 or 10A to the lower base portion 28. Such a jump unit 10A might be painted or otherwise decorated to appear as if it were made of conventional natural building materials, such as for example a pile of logs or similar decoration, as illustrated in FIG. 5, or it may remain unadorned.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A portable jump unit comprising:

two halves joined together along one side with a hinge, said halves pivoting at said hinge so that the halves open to an unfolded, in-use position where the two halves are aligned with each other in a straight line and so that the halves fold to a folded position where the backs of each of the halves are parallel and adjacent to each other, each half provided with a base on which the half rests upon the ground, a lifting means provided on each half which allows the two halves to be lifted simultaneously by grasping both lifting means with a single hand, and fastening means for releasably securing the two halves in their folded position, a curtain provided attached to each said half for draping over a pole extending between two upright standards located at either end of the halves when they are in their unfolded, in-use position.

* * * * *